US006925274B2

(12) United States Patent
Yokoi et al.

(10) Patent No.: US 6,925,274 B2
(45) Date of Patent: Aug. 2, 2005

(54) DEVELOPING DEVICE CAPABLE OF PREVENTING TONER INSIDE DEVELOPING CHAMBER FROM ENTERING HOPPER

(75) Inventors: Katsuyuki Yokoi, Iwakura (JP); Kenjiro Nishiwaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/104,035

(22) Filed: Mar. 25, 2002

(65) Prior Publication Data

US 2002/0141766 A1 Oct. 3, 2002

(30) Foreign Application Priority Data

Mar. 29, 2001 (JP) ..... 2001-096630

(51) Int. Cl.[7] ..... G03G 15/08
(52) U.S. Cl. ..... 399/119; 399/256
(58) Field of Search ..... 399/27, 24, 119, 399/252, 256, 258, 260, 254

(56) References Cited

U.S. PATENT DOCUMENTS 4,632,534 A * 12/1986 Shimono ..... 399/27
4,659,211 A * 4/1987 Oka ..... 399/143
6,192,209 B1 2/2001 Ichikawa et al.
6,226,484 B1 * 5/2001 Ichikawa et al. ..... 399/281
6,336,022 B2 1/2002 Ichikawa et al.

FOREIGN PATENT DOCUMENTS

| | | | | |
|---|---|---|---|---|
| JP | A 60-59375 | | 4/1985 | |
| JP | 05289497 A | * | 11/1993 | ..... G03G/15/08 |
| JP | 06059578 A | * | 3/1994 | ..... G03G/15/08 |
| JP | 06274030 A | * | 9/1994 | ..... G03G/15/08 |
| JP | 8-234569 | * | 9/1996 | |

* cited by examiner

*Primary Examiner*—Quana Grainger
(74) *Attorney, Agent, or Firm*—Oliff & Berridge, PLC

(57) ABSTRACT

A developing device 31 includes three shielding members 20 that divide an inner space of the developing device 31 into a developing chamber 23 and toner hopper chambers 21. The shielding members 20 in predetermined conditions prevent toner inside the developing chamber 23 from entering the toner hopper chambers 21. When toner empty condition of the developing chamber 23 is detected, the shielding member 20*a* is driven to rotate so as to supply toner 22*a* into the developing chamber 23. When the toner empty condition is detected for the second time, then the shielding members 20*a*, 20*b* are driven to rotate for supplying toner 22*b* to the developing chamber 23. In this manner toner can be supplied to the developing chamber 23 without allowing the toner returning to the toner hopper chambers 21.

21 Claims, 6 Drawing Sheets

DEVELOPING DEVICE CAPABLE OF PREVENTING TONER INSIDE DEVELOPING CHAMBER FROM ENTERING HOPPER

BACKGROUND OF THE INVENTION

1. Field of the Invention

The present invention relates to a developing device formed with a housing that houses developing agent and a developing chamber that houses a developing-agent holding member.

2. Related Art

There has been provided a conventional developing device that is used in a leaser printer. Such a developing device is formed with a toner hopper and a developing chamber. The toner hopper houses non-magnetic single-component toner, for example. Positioned inside the developing chamber are a developing roller, a supply roller, a regulation blade, and the like. An opening is formed between the toner hopper and the developing chamber for allowing the toner to freely move between the toner hopper and the developing chamber.

In this configuration, toner is supplied from the toner hopper into the developing chamber as needed, and transported by the supply roller onto the developing roller. Some of the toner on the developing roller is transferred onto a photosensitive member for development, and the remaining is left on the developing roller. For example, when only a small amount of toner is used for development, relatively large amount of toner will remain on the developing roller.

Thus remained toner is collected into the developing chamber. Because toner is freely movable between the developing chamber and the toner hopper through the opening as described above, thus collected toner can return into the toner hopper. When toner repeatedly circulates between the developing roller and the developing chamber or the toner hopper in this manner, the toner will be gradually degraded. As a result, a leaser printer will provide only poor quality images after a long period of use because of the degraded toner, even if the leaser printer can provide a high quality image at the beginning of use.

In order to solve the above problems, Japanese Patent Application Publication No. SHO-60-59375 has proposed a developing device capable of preventing degraded toner from entering a toner hopper. Specifically, the developing device is formed with a vertically extending toner hopper, inside of which is partitioned into three spaces by partitioning members with respect to the vertical direction. When toner empty condition of a developing chamber is detected, the partitioning members are opened one by one, so the toner stored inside the space falls and supplied into the developing chamber by gravity. Because the toner will not enter the toner hopper against the gravity, a high quality image is provided stably.

SUMMARY OF THE INVENTION

However, when a horizontally-extending toner hopper is needed for a compact-size developing device, for example, how to supply the toner into the developing chamber becomes the problem because the toner would not be supplied by its own weight even when the partitioning member is opened. Also, a user needs to manually open the partitioning member. This places a burden on the user, and so it is inconvenient.

It is an objective of the present invention to solve the above problem, and to provide a developing device that prevents degraded toner from entering a toner hopper even in a configuration where toner will not be supplied into a developing device by its own weight only and that does not require a user to perform any additional operation for toner supply.

In order to achieve the above and other objectives, there is provided a developing device including a casing formed with a developing chamber and a hopper chamber, and a first shielding member rotatably positioned between the developing chamber and the hopper chamber. Rotational movement of the first shielding member supplies a developing agent from the hopper chamber to the developing chamber. On the other hand, the first shielding member in a predetermined shielding condition prevents developing agent inside the developing chamber from entering the hopper chamber.

There is also provided a developing agent container including a hopper chamber that accommodates developing agent and a shielding member rotatably provided adjacent to the hopper chamber. The rotational movement of the shielding member supplies the developing agent from the hopper chamber. The shielding member in a predetermined shielding condition prevents developing agent from entering the hopper chamber.

PREFERRED EMBODIMENTS OF THE PRESENT INVENTION

Figure 1:
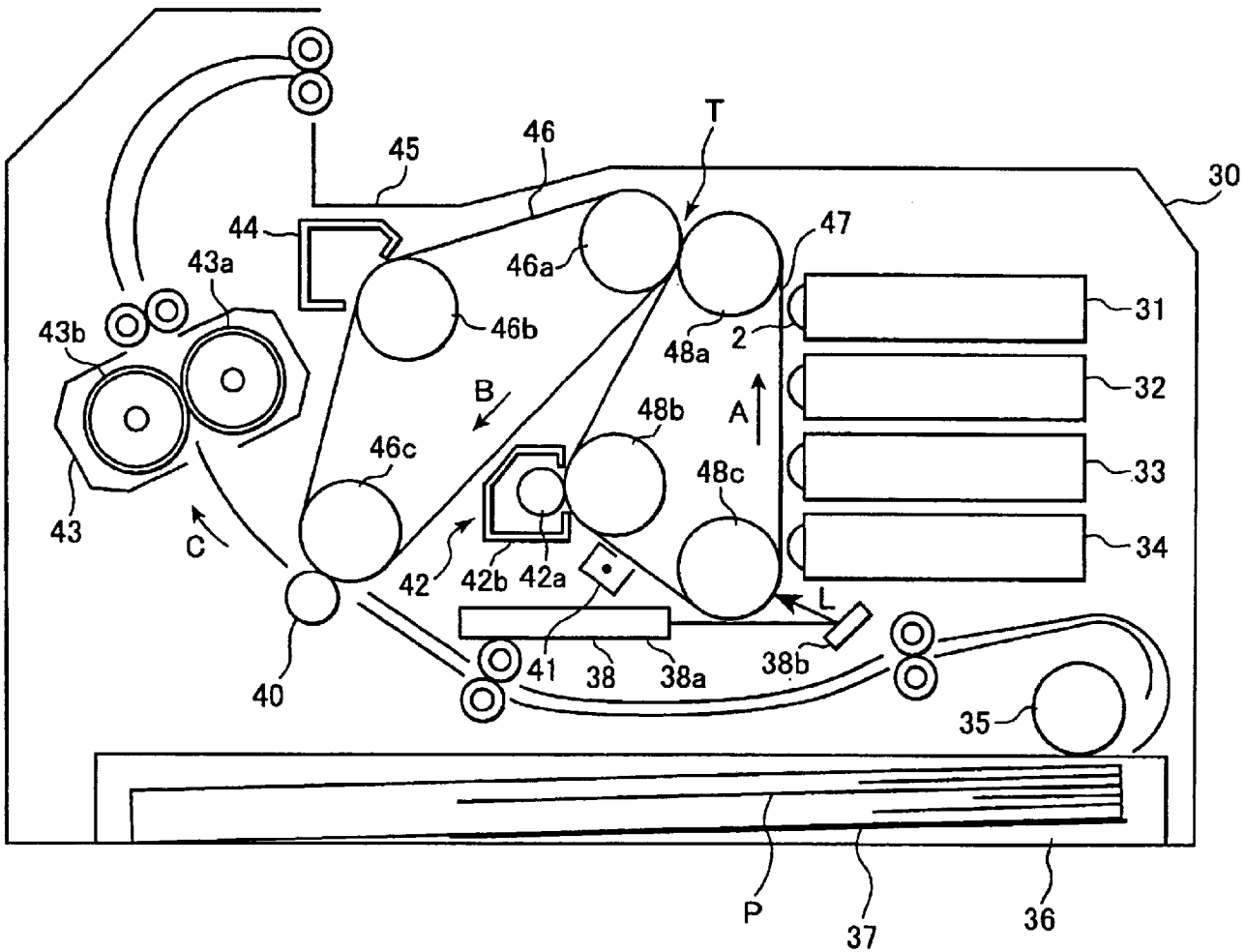
FIG. 1 is a cross-sectional view of a color printer in which developing devices according to an embodiment of the present invention are used.

Next, a developing device according to an embodiment of the present invention will be described while referring to FIGS. 1 to 9. FIG. 1 shows a color printer 30 including developing devices 31, 32, 33, 34 according to the present embodiment.

The color printer 30 includes a photosensitive belt 47, which is wound around three rollers 48*a*, 48*b*, 48*c* so as to be movable in a direction A. The photosensitive belt 47 has a base sheet and a photosensitive surface. The base sheet is a PET film with an aluminum-deposition film, for example. The photosensitive surface is formed of a positively-charging single photosensitive layer.

A charging unit 41 is provided in confrontation with the photosensitive belt 47. The charging unit 41 is a scorotoron charger that uniformly charges the photosensitive surface of the photosensitive belt 47.

A scanner unit 38 is positioned below the charging unit 41. The scanner unit 38 includes a leaser beam source 38*a*, a polygon mirror 38*b*, and a lens (not shown), and the like. The scanner unit 38 irradiates a leaser beam L to the photosensitive belt 47, thereby forming an electrostatic latent image on the photosensitive surface thereof.

The developing devices 31, 32, 33, 34 are arranged side by side along the photosensitive belt 47 in this order with respect to the direction A. The developing devices 31 to 34 house black toner, yellow toner, cyan toner, and magenta toner, respectively, and selectively supply the toner onto the photosensitive belt 47 for developing a visible toner image corresponding to the electrostatic latent image.

An intermediate transfer belt 46 is wound around three rollers 46*a*, 46*b*, 46*c*, which move the intermediate transfer belt 46 in a direction B. The intermediate transfer belt 46 is formed from an electrically conductive polycarbonate sheet, polyimide sheet, or the like. The intermediate transfer belt 46 contacts the photosensitive belt 47 between the rollers 46*a* and 48*a*, defining a transfer position T. The roller 46*a* is electrically charged to a predetermined potential so that a visible toner image formed on the photosensitive belt 47 is transferred onto the intermediate transfer belt 46 at the transfer position T.

A first cleaning unit 42 is positioned in confrontation with the roller 48*b* with the photosensitive belt 47 interposed therebetween. The first cleaning unit 42 includes a scooping member 42*a* and a casing 42*b*. The scooping member 42*a* scoops residual toner remaining on the photosensitive belt 47 and collects the same into the casing 42*b*.

A sheet supply unit 36 is provided at the bottom side of the color printer 30 for supplying recording sheets P. The sheet supply unit 36 includes a tray 37 that houses recording sheets P and a pickup roller 35 that sends out the recording sheets P one at a time at a predetermined timing during the printing operation.

A roller 40 is provided in confrontation with the roller 46*c* with the intermediate transfer belt 46 interposed therebetween. The roller 40 is electrically charged to a predetermined potential, and so when the recording sheet P from the sheet supply unit 36 reaches between the rollers 40 46*c*, the toner image held on the intermediate transfer belt 46 is transferred onto the recording sheet P.

A fixing unit 43 is positioned downstream side of the transfer roller 40 in a sheet feed direction C, and includes a heat roller 43*a* and a pressing roller 43*b*. The rollers 43*a*, 43*b* transport the recording sheet P while applying heat and pressure, thereby fixing the toner image onto the recording sheet P.

A discharge tray 45 is disposed downstream side of the fixing unit 43 in the sheet feed direction C for receiving the recording sheet P discharged from the fixing unit 43. A second cleaning unit 44 is provided opposing the roller 46*b* for removing any residual toner from the intermediate transfer belt 46.

In the color printer 30 with the above configuration, the printing operation is performed in the following manner.

First, the charging unit 41 uniformly charges the photosensitive surface of the photosensitive belt 47. Then, the scanner unit 38 irradiates a leaser beam L corresponding to a magenta image to the charged photosensitive surface. In this manner, an electrostatic image corresponding to the magenta image is formed on the photosensitive belt 47. The developing device 34 selectively supplies magenta toner onto the photosensitive belt 47, thereby developing a visible magenta-toner image corresponding to the electrostatic image.

The developed magenta-toner image is transported to the transfer position T between the rollers 46*a*, 48*a*. Because the roller 46*a* is electrically charged as described above, the magenta-toner image is transferred onto the intermediate transfer belt 46. Residual magenta toner on the photosensitive belt 47 that has not been transferred onto the intermediate transfer belt 46 is further transported to the first cleaning unit 42, which removes the residual magenta toner from the photosensitive belt 47 and collects the same into the casing 42*b*.

Then, the photosensitive belt 47 is again uniformly charged by the charging unit 41. The scanner unit 38 irradiates a leaser beam L corresponding to a cyan image to the charged photosensitive belt 47, so that an electrostatic latent image corresponding to the cyan image is formed on the photosensitive surface. Then, the developing device 33 selectively supplies cyan toner onto the photosensitive belt 47, whereby a visible cyan-toner image is developed on the photosensitive belt 47. The cyan-toner image is transported to the transfer position T and then transferred onto the intermediate transfer belt 46 such that the cyan-toner image is overlaid on the previously transferred magenta-toner image.

The same operation is repeatedly performed for yellow and black images by using the developing devices 32, 31. As a result, a full-color image is formed on the intermediate transfer belt 46. Thus formed full-color image is then transferred onto the recording sheet P at the position between the rollers 40 and 46*c*, and is fixed onto the recording sheet P by the fixing unit 43. The recording sheet P fixed with the full-color image is discharged onto the discharge tray 45. This completes the image forming operation.

Next, detailed description will be provided for the configuration of the developing device 31, 32, 33, 34. Because the developing devices 31 to 34 have the same configuration although each contains different color toner, only the developing device 31 will be described in order to avoid duplication in explanation.

Figure 2:
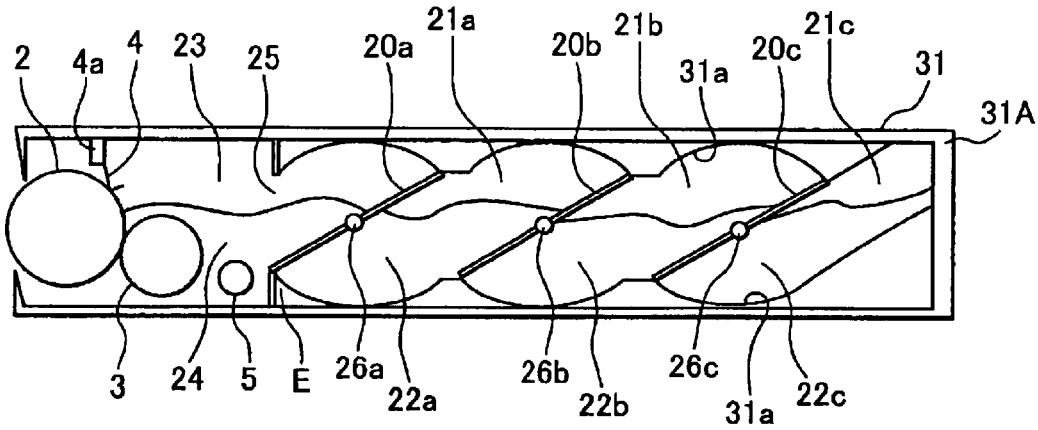
FIG. 2 is a cross-sectional view of a developing device according to the embodiment of the present invention.

FIG. 2 shows a cross-sectional view of the developing device 31. As shown, the developing device 31 includes a casing 31A. Inside the casing 31A is divided by shielding members 20*a*, 20*b*, 20*c* into a developing chamber 23 and three toner hopper chambers 21*a*, 21*b*, 21*c*, each containing toner 24, 22*a*, 22*b*, 22*c*. The developing chamber 23 houses a developing roller 2, a supply roller 3, a regulating blade 4, and a toner empty sensor 5.

The developing roller 2 is formed from an electrically conductive silicon rubber to a column shape, for example, and is formed on its surface with a coating layer of resin containing fluorinate or rubber material. Alternatively, the developing roller 2 could be formed of an electrically conductive urethane rubber. The developing roller 2 is applied with a predetermined voltage so that a predetermined potential difference is generated between the photosensitive belt 47 and the developing roller 2.

The supply roller 3 is formed of an electrically conductive sponge material and positioned to press against the developing roller 2 with its elastic force of the sponge material. The supply roller 3 could be formed of different material instead, such as an electrically conductive silicon rubber or urethane rubber.

The regulating blade 4 is formed of stainless steel or the like and supported by a supporting member 4*a*, which is fixed at its end to the casing 31A. Elasticity of the stainless steel presses the regulating blade 4 against the developing roller 2. The regulating blade 4 could be applied with a predetermined voltage.

The toner empty sensor 5 is a photo-transmitting sensor including a light-emitting portion and a light-receiving portion, for example, and detects an amount of the toner 24 remaining inside the developing chamber 23.

The shielding members 20*a*, 20*b*, 20*c* (hereinafter collectively referred to as "shielding members 20") are supported by shafts 26*a*, 26*b*, 26*c*, respectively, and selectively and independently driven to rotate around the shafts 26*a*, 26*b*, 26*c* in a clockwise direction in FIG. 2. An inner surface 31*a* of the casing 31A defining the toner hopper chambers 21*a*, 21*b*, 21*c* (hereinafter collectively referred to as "toner hopper chambers 21") is shaped to match paths followed by the free ends of the shielding members 20, so that the shielding members 20 rotates while their free ends slidingly contact the inner surface 31*a*. Accordingly, rotation of the shielding members 20 reliably moves toner from the toner hopper chamber 21*a* to the developing chamber 23, from the toner hopper chamber 21*b* to the toner hopper chamber 21*a*, and from the toner hopper chamber 21*c* to the toner hopper chamber 21*b*.

When the shielding members 20 are not driven to rotate, the shielding members 20 are maintained in predetermined shielding conditions shown in FIG. 2, where the shielding members 20 have a predetermined angle with respect to the vertical direction while shielding or closing the toner hopper chambers 21, i.e., the free ends of the shielding members are in contact with the inner surface 31*a*. This prevents toner from flowing among the toner hopper chambers 21 and the developing chamber 23.

The toner used in the present embodiment is a positively-charging non-magnetic single-component developing agent. The toner base particles have an average particle diameter of 9 $\mu$m. For producing-the toner base particles, styrene-acryl-resin formed in spheres by suspension polymerization is added with well-known coloring agent and charge control agent, such as quaternary ammonium salt, nigrosine, or triphenylmethane, or charge control agent. The surface of the toner base particle is added with silica as an outer additive. The silica, which serves as an outer additive, is processed by well-known hydrophobic processes by silane coupling agent or silicone oil. The outer additive has an average particle diameter of 10 nm, and adding amount of the outer additive is 0.6% by weight of the toner base particle.

As described, the toner is suspension polymerization toner with a shape extremely near to completely spherical. Also, silica processed by hydrophobic processes having the average particle diameter of 10 nm is added as outer additive in the amount of 0.6% by weight. Therefore, the toner has extremely excellent fluidity. For this reason, sufficient charge amount can be obtained by friction charging. Further, in contrast to pulverized toners, no corner or edge portion exists in the toner, the spherical toner do not undergo severe mechanical load, and provides excellent followability to the electric field, to thus enhance image transferring efficiency.

Figure 6:
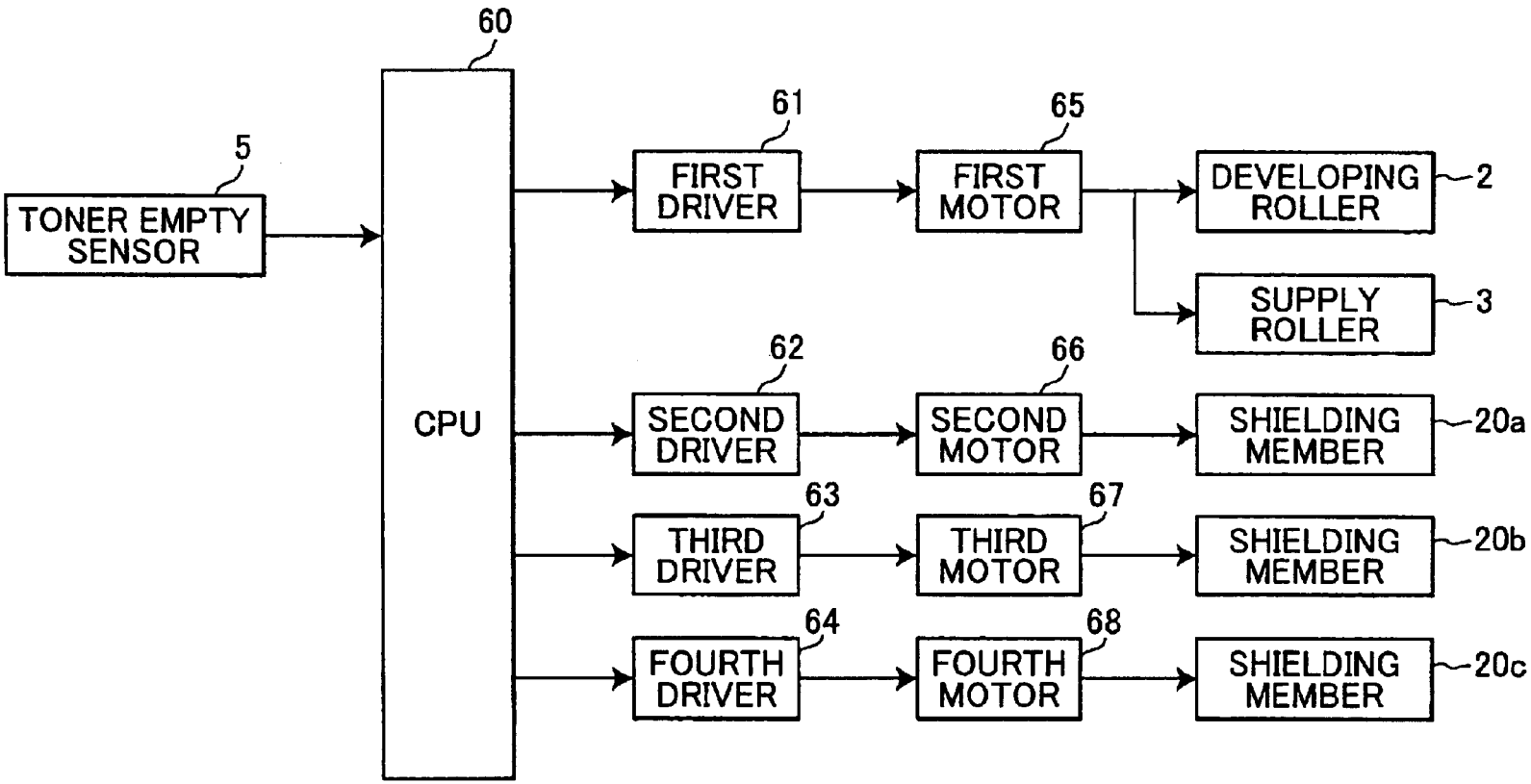
FIG. 6 is a block diagram showing a control mechanism according to the embodiment of the present invention.

A control mechanism of the developing device 31 is shown in FIG. 6. As shown, the developing device 31 further includes a central processing unit (CPU) 60, first to fourth drivers 61 to 64 individually connected to the CPU 60, and first to fourth motors 65 to 68 connected to corresponding drivers 61 to 64. The toner empty sensor 5 is connected to the CPU 60 also, and outputs a detection result to the CPU 60 when a toner empty condition of the developing chamber 23 is detected. The first motor 65 is for driving the developing roller 2 and the supply roller 3. The second, third, and fourth motors 66, 67, 68 are for driving the shielding members 20*a*, 20*b*, 20*c*, respectively.

In the above configuration, the developing roller 2, the supply roller 3, and the shielding members 20 are selectively driven to rotate in response to control signals from the CPU 60. Providing three separate drivers 62, 63, 64 enables to drive the shielding members 20*a*, 20*b*, 20*c* independently. For example, when a toner empty condition of the developing chamber 23 is detected, all of or any one or ones of the shielding members 20 can be driven to rotate.

Next, the operation of the developing device 31 will be described.

In the condition shown in FIG. 2, an amount of the toner 24 inside the developing chamber 23 is sufficient, and also the shielding members 20 are all in the shielding conditions without rotating. In this condition, the supply roller 3 supplies the toner 24 from the developing chamber 23 onto the developing roller 2. The regulating blade 4 regulates the thickness of toner layer formed on the developing roller 2. Rotational movement of the developing roller 2 moves the toner layer to the image forming position where the developing roller 2 confronts the photosensitive belt 47 (FIG. 1). The toner 24 in the toner layer is selectively transferred onto the photosensitive belt 47, thereby developing a visible toner image corresponding to the electrostatic latent image.

The toner 24 that remains on the developing roller 2 without being transferred onto the photosensitive belt 47 returns into the developing chamber 23 as the developing roller 2 further rotates. However, because the shielding member 20*a* is in the shielding condition, the toner 24 is prevented from entering the toner hopper chamber 21*a*. Therefore, the toner 24 will not be mixed into the unused toner 22*a* housed in the toner hopper chamber 21*a*. As the image forming operation, that is, developing operation, further proceeds, the toner 24 is consumed, so that the amount of toner 24 remaining inside the developing chamber 23 gradually decreases. Because the shielding member 20*a* in the shielding condition forms a slop as shown in FIG. 2, toner 24 on the shielding member 20*a* slides down and flows toward the supply roller 3 by its own weight as the remaining amount decreases. When the remaining amount drops lower than a predetermined amount, the toner empty sensor 5 detects the toner empty condition.

Here, toner that is supplied onto the developing roller 2 is applied with a pressing force between the developing roller 2 and the supply roller 3. When the toner is repeatedly applied with such a pressing force over a long period of time without being used for development, the toner will be gradually degraded. However, the toner is hardly degraded in such a short period of time required to consume the toner 24 to bring the toner empty condition. In other words, toner empty condition will be detected before the toner 24 is degraded as much as to affect the image quality.

Accordingly, high quality images are provided throughout the printing operation from the beginning of the use until the detection of the toner empty condition.

Figure 3:
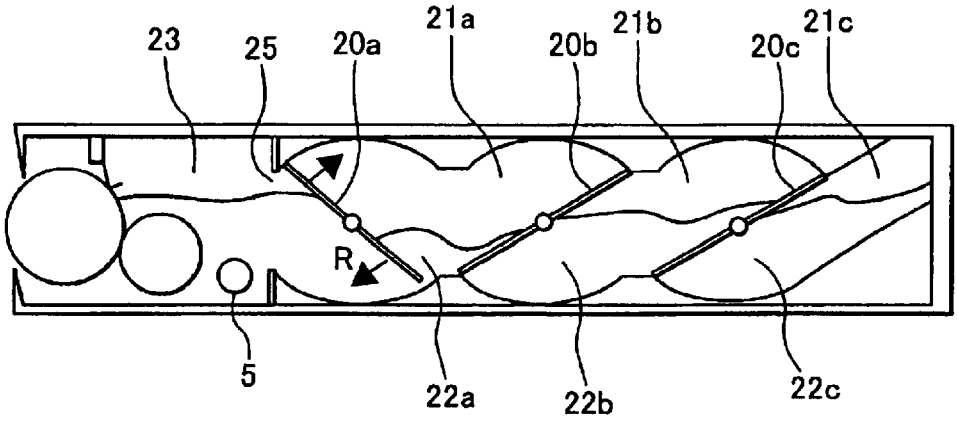
FIG. 3 is a cross-sectional view of the developing device of FIG. 2 with one of shielding members rotating.

When the toner empty sensor 5 detects the toner empty condition for the first time, the CPU 60 outputs a control signal to drive the second motor 66 via the second driver 62 so as to start rotating the shielding member 20*a* as shown in FIG. 3 in a rotational direction indicated by an arrow R, while maintaining the remaining shielding members 20*b*, 20*c* in the shielding conditions. The shielding member 20*a* can rotate either intermittently or continuously.

Figure 4:
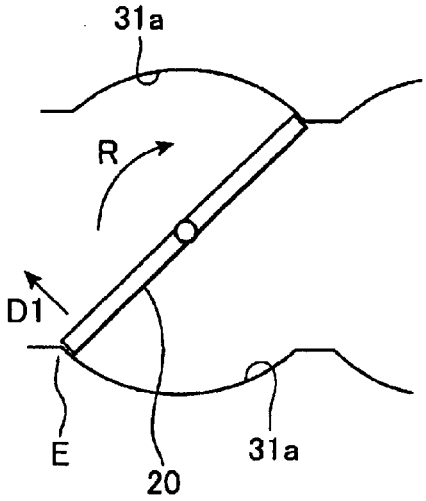
FIG. 4 is a magnified cross-sectional partial view of the developing device.

As shown in FIG. 4, rotation of the shielding member 20*a* sends out the toner 22*a* toward a direction D1 and supplies the same into the developing chamber 23 via an opening 25. The toner 22*a* supplied into the developing chamber 23 in this manner is unused fresh toner and unmixed with any degraded toner. Accordingly, even after the toner supply, high quality images can be provided in the same manner as before the toner supply. Because the shielding member 20*b* in the shielding condition forms a slop (FIG. 3), toner 22*a* on the shielding member 20*b* slides downward along the shielding member 20*b* and is reliably supplied into the developing chamber 23. This prevents the toner 22*a* from lingering at the bottom of the toner hopper chamber 21*a*.

After rotating the shielding member 20*a* for a predetermined time period, which is sufficient to supply all the toner 22*a* into the developing chamber 23, the CPU 60 stops rotating the shielding member 20*a* and waits until the toner empty sensor 5 detects the toner empty condition next time.

Figure 5:
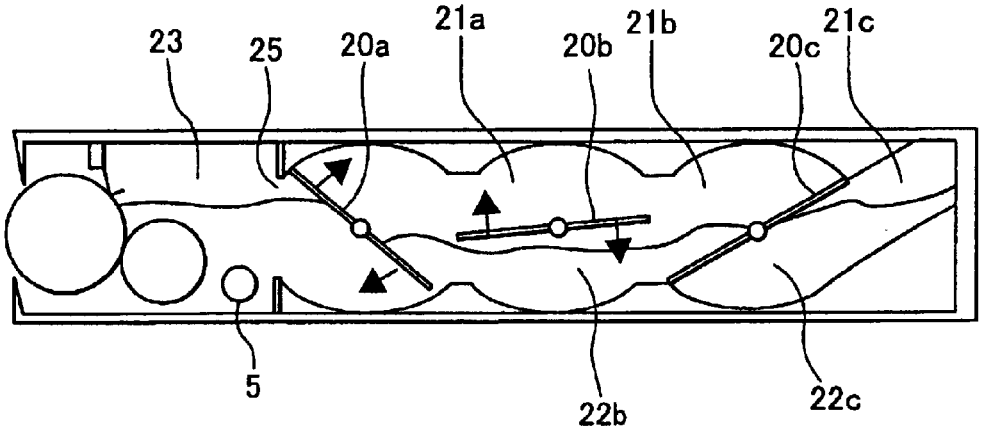
FIG. 5 is a cross-sectional view of the developing device of FIG. 2 with two of the shielding members rotating.

When the toner empty condition is detected next time, the CPU 60 starts rotating the shielding member 20*a* and 20*b* as shown in FIG. 5, either intermittently or continuously. Because the shielding member 20*b* rotates in addition to the shielding member 20*a*, the toner 22*b* inside the toner hopper chamber 21*b* is supplied into the toner hopper chamber 21*a* and further to the developing chamber 23. The toner 22*b* is unused fresh toner and unmixed with any degraded toner, and so high quality images can be provided in the same manner as before. Because the shielding member 20*c* in the shielding condition is slanting, the toner 22*b* on the shielding member 20*c* will slide down toward the shielding member 20*b* and reliably supplied into the developing chamber 23 via the toner hopper chamber 21*a*.

The shielding members 20*a*, 20*b* rotate in a different phase as shown in FIG. 5. This phase difference enables reliable supply of the toner 22*b*. The same is true for when more than two shielding members are driven to rotate simultaneously. It is preferable that the phase difference be 90 degrees.

The CPU 60 stops rotating the shielding members 20*a*, 20*b* when a predetermined time has elapsed, and waits until the toner empty sensor 5 detects the toner empty condition next time.

When the toner empty condition is detected again, then the CPU 60 controls to continuously or intermittently rotate the shielding members 20*a*, 20*b*, 20*c*, via the drivers 62 to 64 and the motors 66 to 68. Accordingly, the unused fresh toner 22*c* inside the toner hopper chamber 21*c* is supplied into the developing chamber 23 in the similar manner as described above. In this case also, adjacent two of the shielding members 20 rotate in different phase.

As described above, according to the present embodiment, the shielding members 20 reliably prevent toner inside the developing chamber 23 from entering the toner hopper chambers 21. Also, rotational movement of the shielding members 20 supplies unused fresh toner into the developing chamber 23. Accordingly, high quality images can be reliably provided in constant.

Moreover, because the shielding members 20 serve as a toner supply means as well as a shielding means, there is no need to provide a toner supply means in addition to a separate shielding means. This simplifies the overall configuration of the developing device 31 and reduces manufacturing costs.

Because of a number of the shielding members 20 that simultaneously rotate is increased one by one in an order starting from one that is closer to the developing chamber 23 every time the toner empty condition is detected, the toner housed inside toner hopper chambers 21 is supplied into the developing chamber 23 in a step manner.

Figure 7:
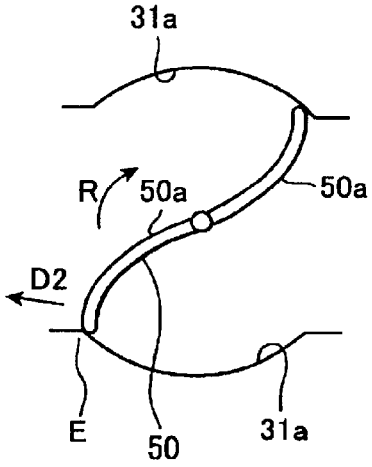
FIG. 7 is a magnified cross-sectional partial view of a developing device according to a modification of the embodiment.

It should be noted that the developing device 31 may have shielding members 50 shown in FIG. 7, rather than the shielding members 20. The shielding members 50 are formed to a curved shape with a convex surface 50*a* facing the rotational direction R. In this configuration, a portion of the convex surface 50*a* will be in a relatively upright posture or vertically extend, when the free end comes to an edge E shown in FIGS. 2 and 7. This enables the shielding members 50 to send out the toner toward a direction D2, which is closer to the horizontal direction compared with the direction D1 in which the shielding members 20 with a flat surface send out the toner as described above (FIG. 4). Accordingly, the shielding members 50 can send out the toner more efficiently than the shielding members 20.

Figure 8:
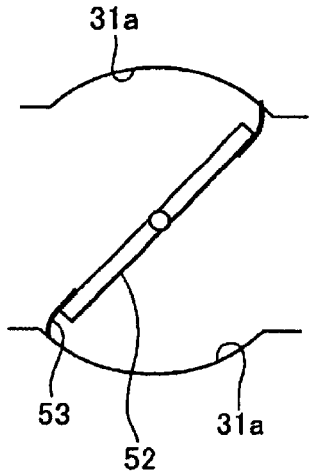
FIG. 8 is a magnified cross-sectional partial view of a developing device according to another modification of the embodiment.

Alternatively, as shown in FIG. 8, shielding members 52 having free ends with resilient members or film members 53 attached thereto could be used. This configuration suppresses gride or annoying noise during the rotation of the shielding members 52 because the film members 53 slide on the inner surface 31*a* during the rotation. Also, the film members 53 improve the shielding condition among the developing chamber 23 and the toner hopper chambers 21, so that toner inside the developing chamber 23 is more reliably prevented from entering the toner hopper chambers 21.

The film member 53 could be provided only to one free end of the shielding members 52, rather than to both free ends. Still alternatively, the shielding members 52 themselves could be formed from a resilient material or a film material so that the film members 53 are dispensed with.

Figure 9:
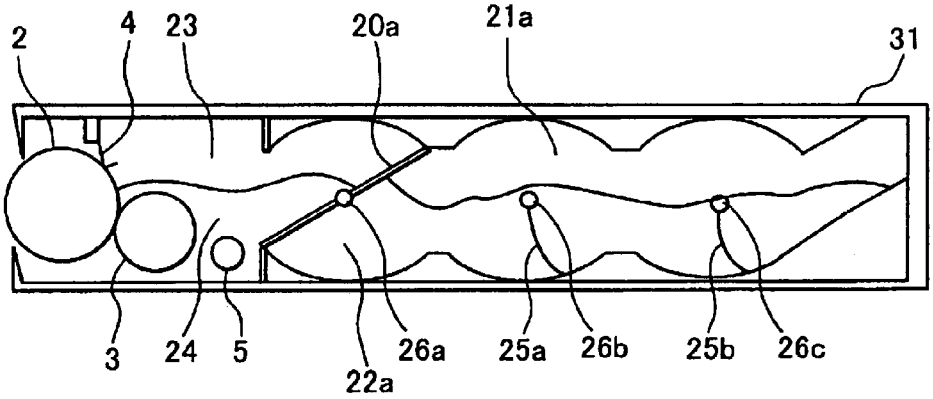
FIG. 9 is a cross-sectional view of a developing device according to still another modification of the embodiment.

FIG. 9 shows a modification of the embodiment, where the shielding members 20*b* and 20*c* are replaced by shielding members 25*a* and 25*b*, which extend to only a single direction from the shafts 26*b*, 26*c*, rather than to two opposing directions. In this configuration also, toner can be prevented from entering the toner hopper chambers 21 from the developing chamber 23, and unused fresh toner can be supplied into the developing chamber 23 by controlling the rotational movement of the shielding members 25*a*, 25*b* and by controlling the rotation amount of the shielding member 20*a*.

While some exemplary embodiments of this invention have been described in detail, those skilled in the art will recognize that there are many possible modifications and variations which may be made in these exemplary embodiments while yet retaining many of the novel features and advantages of the invention.

Although in the above embodiments the developing device 31 is placed to extend in the horizontal direction, this is not the limitation of the present invention. That is, the present invention can be used in any type of devices where a developing chamber cannot be supplied with toner by means of the weight of the toner itself, such as in a device placed in angled direction rather than horizontal direction.

In the above embodiments, the shielding members are driven to rotate when the toner empty condition is detected. However, the shielding members can be driven to rotate in a predetermined time interval regardless of the toner amount inside the developing chamber, although rotating the shielding members only when the toner empty condition is detected is advantageous because the rotation of the shielding members can be minimized and so the toner degradation due to the rotation of the shielding members is also minimized.

Figure 10:
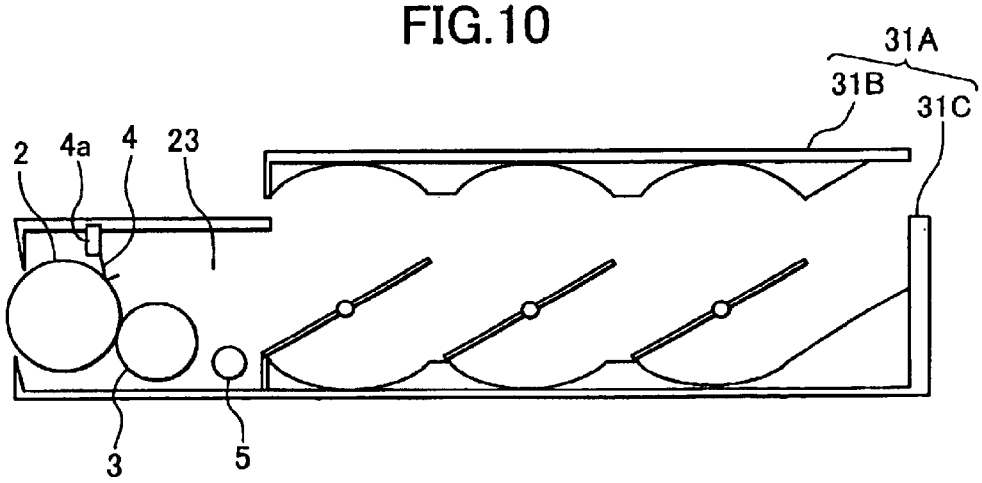
FIG. 10 is an exploded view of a developing device where an upper cover of a casing is separated from a main part thereof.

As shown in FIG. 10, the casing 31A could be provided with an upper cover 31B capable of separating from a main part 31C of the casing 31A. This configuration makes easier to replenish toner into the toner hopper chambers. Moreover, the developing device can be formed with only a single toner hopper chamber rather than a plurality of toner hopper chambers.

The developing device of the present invention can be used in printers other than the above-described printer. For example, the developing device can be used in a monochromatic printer rather and the color printer, in a printer including photosensitive drum rather than the photosensitive belt, in a printer using multi stylus electrode or in a printer capable of direct control on toner flow, where no photosensitive member is provided.

Figure 11:
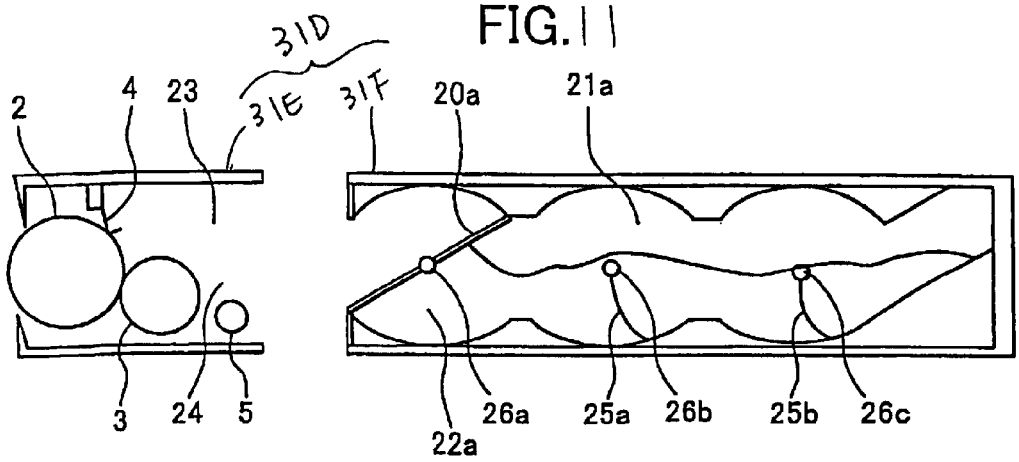
FIG. 11 is a cross-sectional view of a developing device according to a modification of the embodiment where a toner hopper member is detachably provided to a main body of the developing device.

In the above-described embodiment, the toner hopper chamber is formed integrally with the developing chamber. However, the present invention could also be applied to a so-called toner box (FIG. 11) where a toner hopper member 31F formed with a toner hopper chamber is detachable from a main body 31F of the developing device 31D. In this case, the toner hopper member 31F alone may be carried around, and so a stopper should be provided to the rotatable shielding member for preventing idle rotation.

Further, the toner is not limited to a non-magnetic single-component developing agent produced by polymerization, but can be produced by pulverization.

What is claimed is:

1. A developing device comprising:

a casing formed with a developing chamber and a hopper chamber;

a first shielding member rotatably positioned between the developing chamber and the hopper chamber; and at least one second shielding member having a first end and a second end opposite said first end, the second shielding member rotatably positioned inside the hopper chamber, wherein rotational movement of the first shielding member supplies a developing agent from the hopper chamber to the developing chamber;

the first shielding member in a predetermined shielding condition prevents developing agent inside the developing chamber from entering the hopper chamber;

the second shielding member divides the hopper chamber into a plurality of sub-chambers by simultaneously contacting opposing inner surfaces of the hopper chamber with said first end and said second end; and rotational movement of the second shielding member moves developing agent housed inside the sub-chamber toward the developing chamber.

2. The developing device according to claim 1, wherein the first shielding member in the predetermined shielding condition has a predetermined angle with respect to the vertical direction.

3. The developing device according to claim 1, further comprising:

a detecting member that detects an empty condition when an amount of developing agent remaining inside the developing chamber is lower than a predetermined amount; and a control unit that rotates the first shielding member for a predetermined time duration when the detecting member detects the empty condition.

4. The developing device according to claim 1, wherein a number of first and second shielding members that simultaneously rotate is increased one by one every time the empty condition is detected, in an order starting from one that is closer to the developing chamber, such that developing agent housed inside the plurality of sub-chambers is supplied into the developing chamber in a step manner.

5. The developing device according to claim 1, wherein adjacent two of the first shielding member and the at least one second shielding member rotate simultaneously with a different phase.

6. The developing device according to claim 1, wherein the first shielding member has a curved cross-section with a convex surface facing a rotational direction of the first shielding member.

7. The developing device according to claim 6, wherein the casing has an inner surface defining the developing chamber and the hopper chamber, the inner surface being formed with an edge protruding inwardly, and a portion of the first shielding member extends in an approximate vertical direction when an free end of the first shield member locates at the edge.

8. The developing device according to claim 1, wherein the casing has a main body and an upper cover detachably mounted on the main body.

9. The developing device according to claim 1, wherein the casing has a first portion and a second portion detachably mounted onto the first portion, the first portion defining developing chamber, the second portion defining the hopper chamber.

10. The developing device according to claim 1, further comprising a developing-agent holding member positioned inside the developing chamber.

11. The developing device according to claim 1, wherein the casing has an inner surface defining the hopper chamber, the inner surface being shaped to match a path followed by free ends of the first shielding member.

12. A developing device comprising:

a casing formed with a developing chamber and a hopper chamber; and a first shielding member rotatably positioned between the developing chamber and the hopper chamber, wherein rotational movement of the first shielding member supplies a developing agent from the hopper chamber to the developing chamber;

the first shielding member in a predetermined shielding condition prevents developing agent inside the developing chamber from entering the hopper chamber;

the developing chamber and the hopper chamber are arranged side by side in a horizontal direction;

at least one second shielding member having a first end and a second end opposite said first end, the second shielding member rotatably positioned inside the hopper chamber, the second shielding member divides the hopper chamber into a plurality of sub-chambers by simultaneously contacting opposing inner surfaces of the hopper chamber with said first end and said second end, wherein the developing chamber and the plurality of sub-chambers are arranged side by side in the horizontal direction; and the casing has an inner surface define the hopper chamber, the inner surface being shaped to match paths followed by free ends of the first shielding member and the second shielding member.

13. The developing device according to claim 12, wherein the first shielding member and the second shielding member are formed of a resilient material.

14. The developing device according to claim 12, wherein the first shielding member and the second shielding member include a main body and resilient members attached to free ends of the main body.

15. A developing agent container, comprising:

a hopper chamber that accommodates developing agent;

a first shielding member rotatably provided adjacent to the hopper chamber; and at least one second shielding member having a first end and a second end opposite the first end, the second shielding member rotatably positioned inside the hopper chamber, wherein rotational movement of the first shielding member supplies the developing agent from the hopper chamber;

the first shielding member in a predetermined shielding condition prevents developing agent from entering the hopper chamber;

the second shielding member divides the hopper chamber into a plurality of sub-chambers by simultaneously contacting opposing inner surfaces of the hopper chamber with said first end and said second end; and rotational movement of the second shielding member moves developing agent housed inside the sub-chambers.

16. The developing agent container according to claim 15, wherein the first shielding member in the predetermined shielding condition has a predetermined angle with respect to the vertical direction.

17. The developing agent container according to claim 15, wherein the hopper chamber is defined by an inner surface of a casing, the inner surface being shaped to match a path followed by free ends of the first shielding member.

18. A developing device comprising:

a casing formed with a developing chamber and a hopper chamber;

a first shielding member rotatably positioned between the developing chamber and the hopper chamber; and at least one second shielding member having a first end and a second end opposite said first end, the second shielding member rotatably positioned inside the hopper chamber, wherein rotational movement of the first shielding member supplies a developing agent from the hopper chamber to the developing chamber;

the first shielding member in a predetermined shielding condition prevents developing agent inside the developing chamber from entering the hopper chamber;

the second shielding member divides the hopper chamber into a plurality of sub-chambers by simultaneously contacting opposing inner surfaces of the hopper chamber with said first end and said second end; and the developing chamber and the plurality of sub-chambers are arranged side by side in a horizontal direction.

19. The developing device according to claim 18, wherein the casing has an inner surface defining the hopper chamber, the inner surface being shaped to match paths followed by free ends of the first shielding member and the second shielding member.

20. The developing device according to claim 18, wherein the first shielding member and the second shielding member are formed of a resilient material.

21. The developing device according to claim 18, wherein the first shielding member and the second shielding member include a main body and resilient members attached to free ends of the main body.

* * * * *